United States Patent [19]

Muto

[11] 4,099,433

[45] Jul. 11, 1978

[54] APPARATUS FOR PROVIDING ADHESIVE STRIPS OF PREDETERMINED LENGTH

[75] Inventor: Teruhide Muto, Tokyo, Japan

[73] Assignees: Shinko Industries Co., Ltd., Tokyo; Toyonaka Kosakusho Co., Ltd., both of Japan

[21] Appl. No.: 815,275

[22] Filed: Jul. 13, 1977

[30] Foreign Application Priority Data

Jul. 14, 1976 [JP] Japan ..... 51-83801

[51] Int. Cl.[2] ..... B65H 45/14

[52] U.S. Cl. ..... 83/155; 83/158; 83/161; 83/266; 83/277; 83/628; 83/649; 156/519

[58] Field of Search ..... 156/519, 521, 522, 523; 83/154, 155, 161, 158, 277, 266, 628, 227, 649

[56] References Cited

U.S. PATENT DOCUMENTS

| | | | |
|---|---|---|---|
| 1,124,577 | 1/1915 | Allen | 156/519 X |
| 3,540,969 | 11/1970 | Jorgensen | 156/519 X |

*Primary Examiner*—Frank T. Yost

[57] ABSTRACT

Apparatus for providing adhesive strips having a predetermined length includes a rotatable reel for support of a roll of adhesive tape. A conveyor, which may be a rotatable turn table, is provided for supporting thereon a plurality of adhesive strips which have been cut to a predetermined length from the roll of adhesive tape. A feed member is pivotably supported adjacent one end thereof for movement between a first position adjacent the reel and a second position adjacent the conveyor. The feed member carries a stationary cutter plate and a cutter bar which is reciprocable therealong and is cooperable with the cutter plate to cut adhesive tape withdrawn from the reel into strips of the predetermined length. The feed member carries at its outer end a latch plate for selectively grasping and retaining the free end of adhesive tape withdrawn from the reel. A lever rod is carried by the feed member and is movable longitudinally thereof and is operably connected to the latch plate. A series of cams are drivable to sequentially move the feed member, latch plate, cutter bar and conveyor. By the arrangement of the invention predetermined lengths of adhesive tape are serially withdrawn from the reel by pivotal movement of the feed member from the first position to the second position and are positioned on the conveyor, the cutter bar is reciprocated into cooperation with the cutter plate so as to cut the tape into the strips upon return of the feed member to the first pivotal position.

10 Claims, 10 Drawing Figures

APPARATUS FOR PROVIDING ADHESIVE STRIPS OF PREDETERMINED LENGTH

BACKGROUND OF THE INVENTION

The present invention relates to apparatus for providing adhesive strips of predetermined length, and more particularly to the provision of selective numbers of such adhesive strips upon a movable conveyor for the strips such as a rotatable turn table or a belt conveyor.

Devices have been known heretofore for supplying pre-cut lengths of adhesive tape. However, prior devices frequently resulted in marring of the adhesive portion of the tape, were relatively complex, and were not sufficiently versatile so as to be able to easily vary the length of the adhesive strip and to afford precise and reliable cutting of the strips from the roll.

SUMMARY OF THE INVENTION

It is one object of this invention to provide apparatus of the character described which can readily be integrated into a packaging or like operation without effecting any decrease in the overall efficiency of the operation.

It is another object of this invention to provide apparatus of the character described which minimizes the possibility of any marring or contamination of the tape during the cutting and supplying steps, so as not to adversely affect the adhesive capability of the tape or strips cut therefrom or the appearance of such strips.

It is still another object of the invention to provide apparatus of the character described which is substantially entirely automatic.

It is yet another object of the invention to provide apparatus of the character described whereby a supply of adhesive strips may be provided in accordance with the number of persons using the apparatus as a source of adhesive strip supply and the rate at which such adhesive strips are consumed.

It is a further object of the invention to provide apparatus of the character described in which the length of adhesive strips to be cut from a roll of adhesive tape can readily be changed as desired.

Other objects and advantages of the invention will become readily apparent to persons versed in the art from the ensuing description of the invention.

SUMMARY OF THE INVENTION

According to the present invention, there is provided apparatus for providing adhesive strips of predetermined length comprising in combination a rotatably mounted support member for a roll of adhesive tape; means for supporting a plurality of adhesive strips which have been cut to a predetermined length; a feed member pivotably supported for pivotal movement between a first position adjacent said adhesive tape support member and a second position adjacent said adhesive strip support means, said feed member being provided with a cutter plate and a cutter bar movable longitudinally thereof and cooperable with said cutter plate to cut the adhesive tape into strips of predetermined length; means carried by said feed member for retaining the free end of the adhesive tape of said roll; a lever rod carried by said feed member movable longitudinally thereof and operably connected to said tape retaining means; and a plurality of cam means drivable to sequentially move said feed member, tape retaining means, cutter bar and adhesive strip support means; whereby predetermined lengths of adhesive tape are serially withdrawn from said tape support member by pivotal movement of said feed member from said first position to said second position and positioned on said adhesive strip support means, and cut into strips of predetermined length by said cutter bar in cooperation with said cutter plate upon return of said feed member to said first position.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
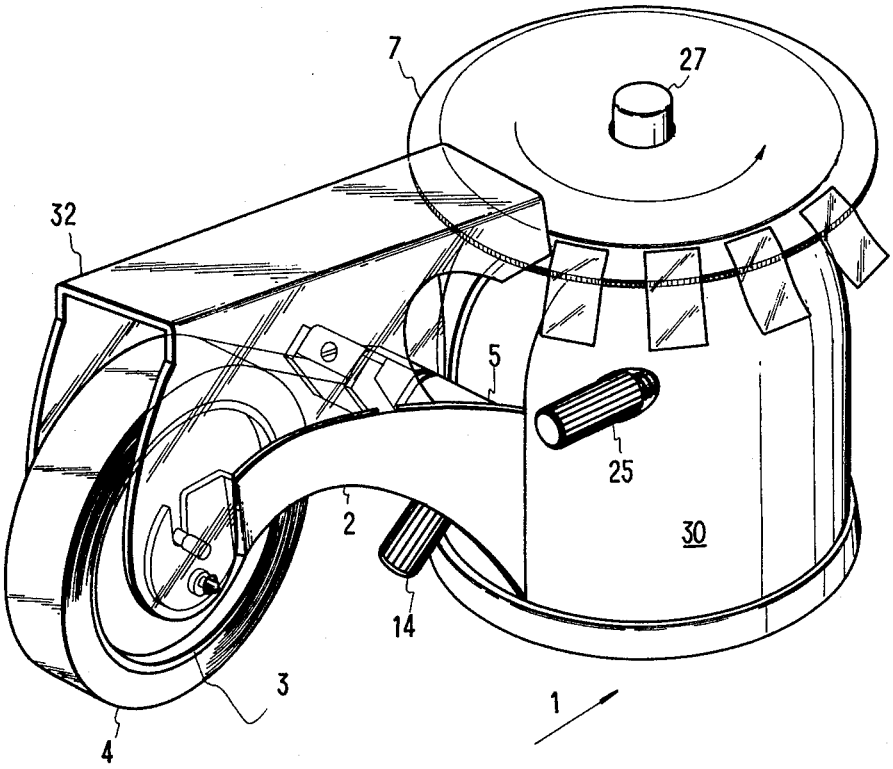
FIG. 1 is a perspective view of apparatus for providing adhesive strips of predetermined length embodying the features of the invention.
Figure 2:
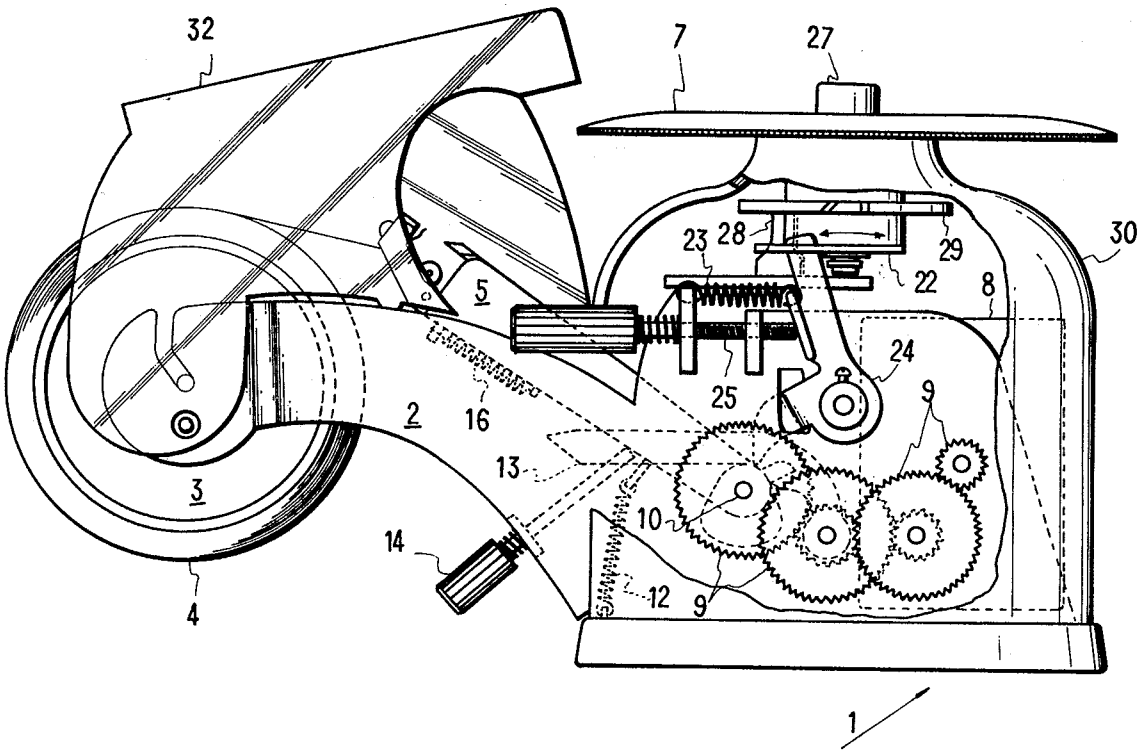
FIG. 2 is a side elevational view, with the cover partially removed, of the device shown in FIG. 1.
Figure 3:
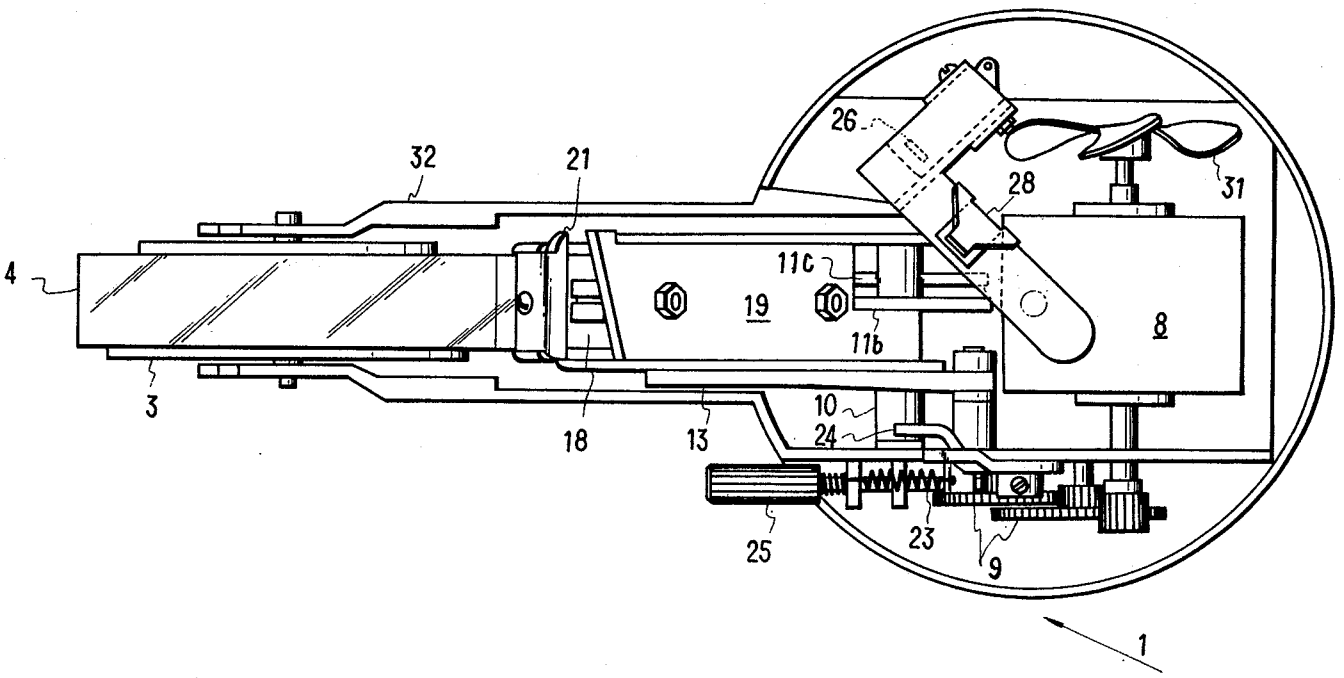
FIG. 3 is a top plan view of the device shown in FIG. 1 with the top cover removed.

Referring to the drawings, and particularly to FIGS. 1 – 3 thereof, there is shown a device for providing a supply of adhesive strips having a predetermined length comprising a frame 1 having a base such that the device may be supported upon a surface such as that of a work table (not shown) or the like. The frame is provided with an arm 2 which extends laterally therefrom and is adapted at its outer end to journal a rotatable support member such as a reel 3 thereon. The reel carries a roll of adhesive tape thereon with the free end of the tape unwindable so as to pass through a feed member 5. The frame is provided with a suitable cover 30 and the arm 2 with a casing 32 enclosing at least the upper portion of the reel and the feed member.

The feed member 5 is generally elongated and is desirably mounted loosely upon a shaft 10 carried rotatably by the frame. The feed member 5 includes a slide bar 15 having a cutter plate 21 positioned at the outer end thereof. Mounted pivotably at the end of the slide bar adjacent the cutter plate is a latch plate 18. An opening 6 extends through the end of the feed member such that the free end of the adhesive tape 4 may pass therethrough. When the latch plate is in its upper pivotal position, as epicted in FIG. 4, the free end of the tape is grasped by the latch plate and retained in the end portion of the feed member.

Figure 7:
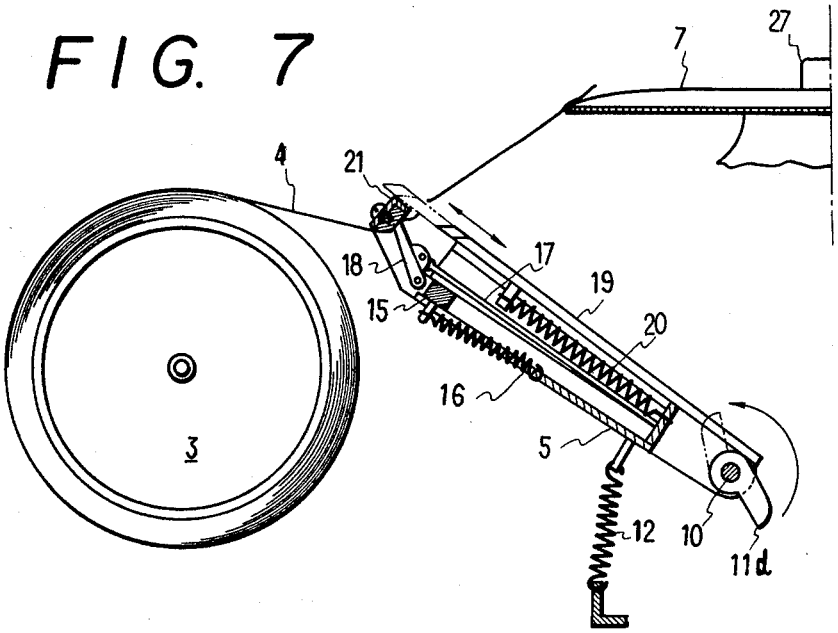

A cutter bar 19 is carried reciprocably by the feed member and is cooperable with the cutter plate as shown in FIG. 7, so as to cut a strip of adhesive tape from the roll when reciprocated outwardly under the influence of cam **11*d* as shown in FIG. 7. The cutter bar is biased downwardly out of engagement with the cutter plate by means of spring 20**.

Figure 6:
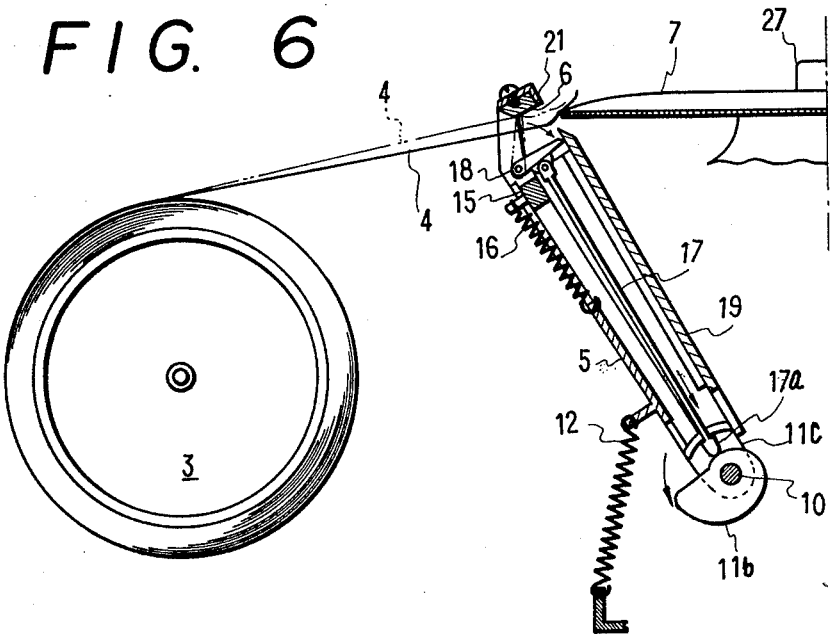

A lever rod 17 is carried by the feed member and is movable longitudinally thereof under the influence of cam **11*b***. The upper portion of the lever rod is pivotably connected to the latch plate so as to pivot the latch plate between the position depicted by dotted line in FIG. 4 so as to grasp and retain the free end of the adhesive tape and a lower pivotal position as depicted in FIG. 6. The lower end of the lever rod is given an enlarged head 17*a* adapted to ride upon the surface of cam 11*b* for the imparting of reciprocal movement to the lever rod during the operational phases of the device.

A plurality of cams 11*a*, 11*b*, 11*c* and 11*d* are carried by shaft 10 for rotation therewith. The function of these cams will be hereinafter described. It will, however, be seen from FIG. 2, that motor 8 drives shaft 10 and the cams thereon through a gear train 9. As will be readily understood, such gears are selected to drive the shaft at the desired rate of speed, the cams being contoured as to impart the correct sequential movement of the feed member 5 and the components carried thereon, as well as pivotal movement of oscillating lever 24 for incremental indexing of the conveyor or turn table 7.

Throughout the pivotal movement of the feed member 5 it is maintained under a predetermined biasing force of spring 12 which is connected to the frame of the device. Also, an adjusting screw 14 is provided for limiting the pivotal movement of the feed member in a direction towards reel 3, as can clearly be seen from FIG. 4.

As stated above, cams 11*a*, 11*b*, 11*c* and 11*d* are mounted upon a common shaft 10. An oscillating lever 13 is mounted somewhat to the rear of the feed arm and is operably connected thereto, such that when cam 11*a* is rotated to the position shown in FIG. 4, the feed member 5 will be pivoted counter clockwise until it engages with the end of the adjusting screw 14. Upon rotation of shaft 10 and cam 11*a* thereon to the position shown by phantom line in FIG. 4, the oscillating lever 13 will effect pivotal movement of the feed member 5 to a second pivotal position adjacent the turn table 7. Thus, it will be seen, that the extent of pivotal movement of the feed member, and thereby the length of adhesive tape withdrawn from the reel, is determined by adjusting screw 14 and the configuration of cam 11*a*.

Control of the lever rod 17 is determined by cam 11*b*, the enlarged head 17*a* of the lever rod being in sliding contact with cams 11*b* and 11*c*.

Figure 9:
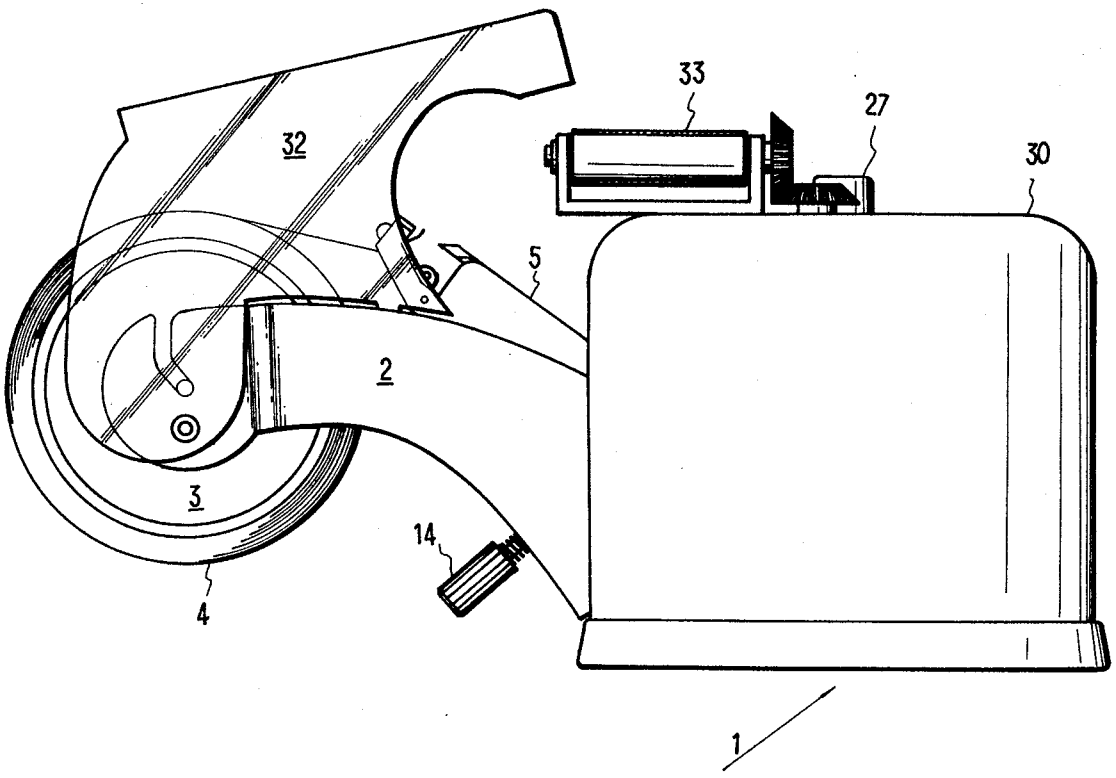
FIG. 9 is a perspective view of a second embodiment of the device of the invention.
Figure 10:
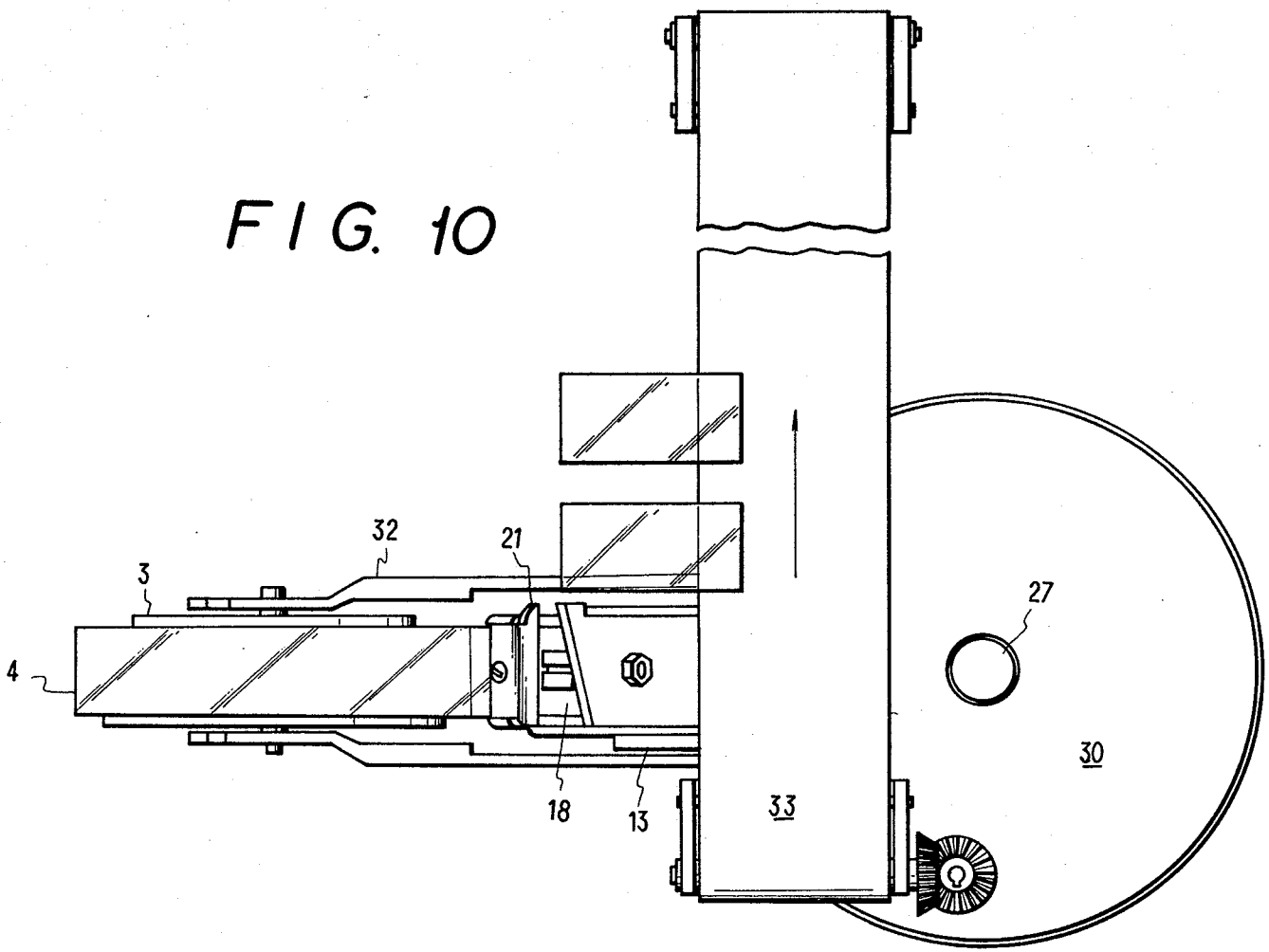
FIG. 10 is a top plan view of the device shown in FIG. 9.

Cam 11*d* is operable upon the lower end of the cutter bar 19 such that when the cam is in the position indicated by phantom line in FIG. 7, the cutter bar will be reciprocated to its upper position into cooperation with cutter plate 21 for cutting of the tape into strips having the desired length. The upper free end engages a ratchet member 22, and oscillatable lever 24 is given a more or less hook-shape terminal portion engageable with the peripheral surface of cam 11*c* for controlling rotation of the turn table 7 against the direction imparted by the ratchet member. In this manner, either rotation of the turn table or movement of a belt conveyor 33 (shown in FIGS. 9 and 10) may be controlled. A spring 23 is provided for biasing of the lever 24, and an adjusting screw 25 is provided to regulate the incremental distances by which either the turn table or the conveyor are moved.

Figure 8:
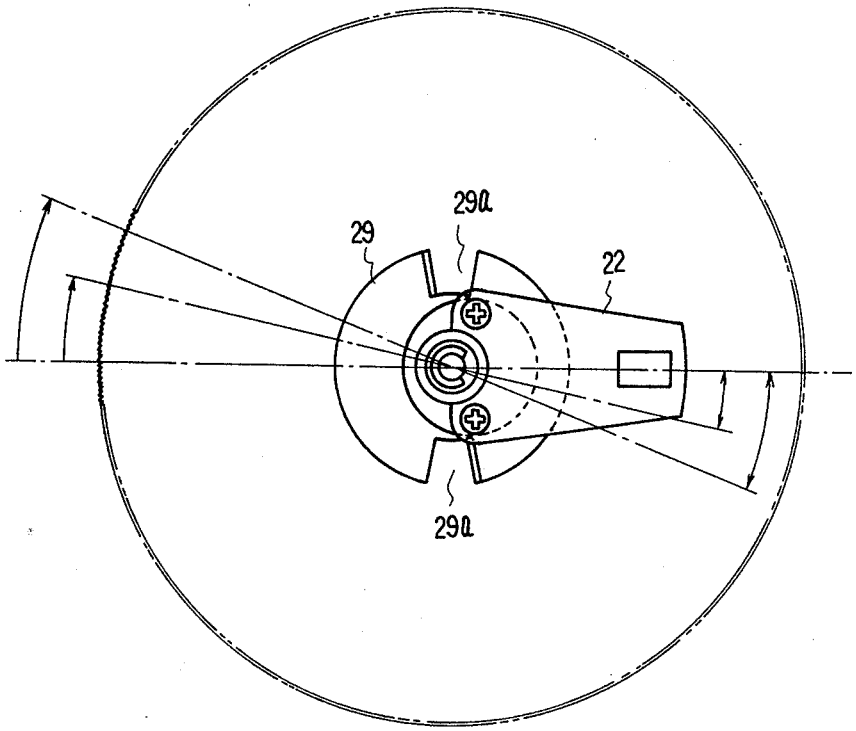
FIG. 8 is a top plan view of the control plate and a portion of the ratchet member of the device.

Motor 8 may be activated by a power supply switch (not shown) and by means of a microswitch 26 which is closed by depression of a push button 27 mounted in the frame and projecting through the center of the turn table 7. A switch operating rod 28 is erected on microswitch 26 and is cooperable with a control plate 29 positioned beneath the turn table 7 rotated by the ratchet member 22. As can be seen most clearly from FIG. 8, control plate 29 is provided with diametrically opposed notches 29*a*.

Figure 4:
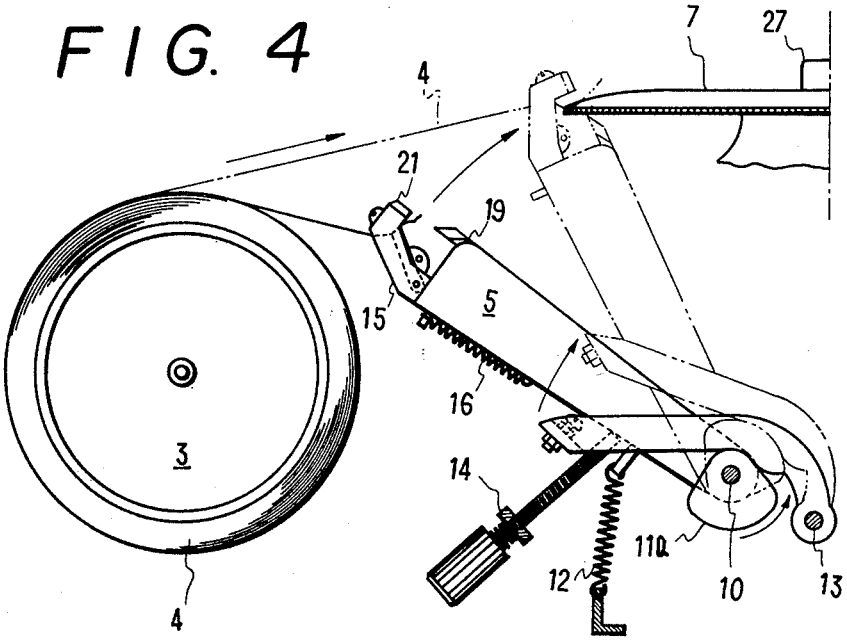
FIGS. 4, 5, 6 and 7 are fragmentary side views of the device in various phases of operation.
Figure 5:
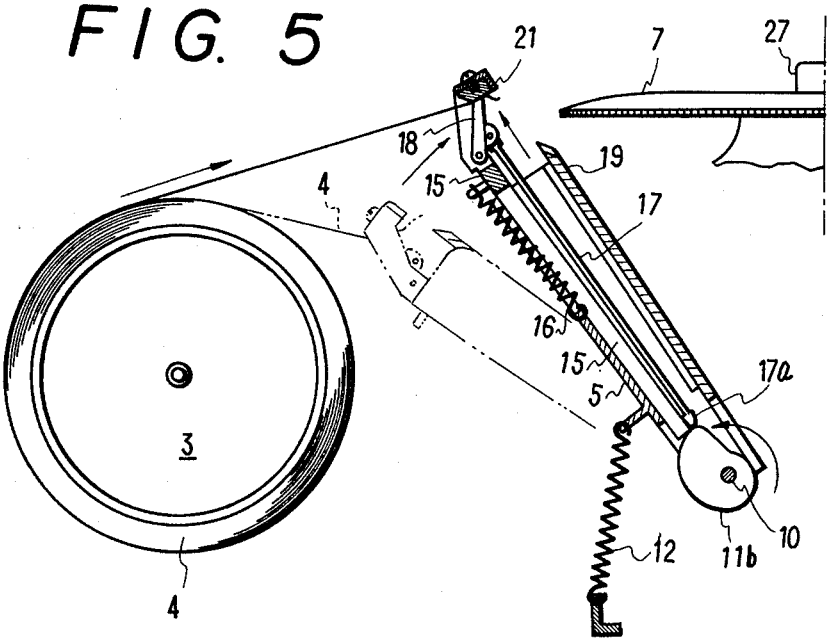

The operation of the device of this invention will now be described with reference to FIGS. 4, 5, 6 and 7. Tape 4 which is supplied from reel 3 is guided through opening 6 in feed member 5. The feed member, as shown in FIG. 4, is pivoted into a first pivotal position against adjusting screw 14. In this position lever rod 17 is moved into its upward position so as to pivot latch plate 18 into gripping relationship with the free end of the tape. As shaft 10 rotates in a counter clockwise direction, the oscillatable lever 13 is pivoted in a clockwise direction carrying with it the feed chamber 5. A length of tape is unwound from the reel and the free end thereof is juxtaposed adjacent the edge of the turn table 7 or, as the case may be, against a side edge of conveyor belt 33 as can be seen from FIG. 10. Cam 11*b*, also rotated in a counter clockwise direction, on shaft 10, urges lever rod 17 upwardly and thereby also causes slide bar 15 to slide upwardly and to cause the free end of the tape to adhere to the end of the turn table 7 or conveyor belt 33. Cam 11*b* then effects a shifting of lever rod 17 downwardly, so as to pivot the latch plate out of gripping relation with the tape. Oscillating lever 13 is then pivoted from the position shown in phantom line in FIG. 4 to the position shown by solid line, so as to return the feed member 5 to the position shown in FIG. 7. The lever rod 17 is again reciprocated upwardly and tape 4 is retained within the feed chamber. Cam 11*d* at such time has been rotated into a position so as to reciprocate cutter bar 19 to the position shown by phantom line in FIG. 7, such that it cooperates with cutter plate 21 to cut tape 4 into a strip of adhesive tape having the desired length. During this operation cam 11*d* causes lever 24 to oscillate and engage the ratchet member 22 for rotation of the turn table 7 or conveyor belt 33 by an amount regulated by adjusting screw 25. It will, of course, be understood that while the range or extent of peripheral operating rotation has been determined by the distance from notch 29*a* to the opposed notch in the control plate, the operational control can be varied depending upon the nature of the work.

From the foregoing description it will be seen, that a device has been provided for the supply of adhesive strips having predetermined length which is substantially completely automatic and which can easily be regulated, so as to obtain strips of the desired length.

Various modifications and changes have been suggested in the foregoing description. Others will be obvious to those skilled in this art. Consequently, it is intended that the present disclosure be illustrative only and not limiting of the scope of the invention.

What is claimed:

1. Apparatus for providing adhesive strips of predetermined length comprising in combination:

a rotatably mounted support member for a roll of adhesive tape;

means for supporting a plurality of adhesive strips which have been cut to a predetermined length;

a feed member pivotably supported for pivotal movement between a first position adjacent said adhesive tape support member and a second position adjacent said adhesive strip support means, said feed member being provided with a cutter plate and a cutter bar movable longitudinally thereof and cooperable with said cutter plate to cut the adhesive tape into strips of predetermined length;

means carried by said feed member for retaining the free end of the adhesive tape of said roll;

a lever rod carried by said feed member movable longitudinally thereof and operably connected to said tape retaining means;

and a plurality of cam means drivable to sequentially move said feed member, tape retaining means, cutter bar and adhesive strip support means; whereby predetermined lengths of adhesive tape are serially withdrawn from said tape support member by pivotal movement of said feed member from said first position to said second position and positioned on said adhesive strip support means, and cut into strips of predetermined length of said cutter bar in cooperation with said cutter plate upon return of said feed member to said first position.

2. Apparatus according to claim 1, wherein said feed member is provided with a slide bar movable longitudinally thereof, said tape retaining means being a latch plate pivotably mounted at an end of said slide bar, and said lever rod being pivotably connected at one end thereof with said latch plate, said feed member having an opening dimensioned to permit the passage of the adhesive tape therethrough and said latch plate being pivotable to selectively grasp and retain the free end of the adhesive tape in one pivotal position thereof and to release such tape in another pivotal position thereof.

3. Apparatus according to claim 1, wherein said feed member is mounted pivotably on a shaft and said cam means includes a first cam operable to engage with one end of said lever rod to cyclically reciprocate said lever rod relative to said feed member and a second cam operable to engage with one end of said cutter bar to cyclically reciprocate said cutter bar relative to said cutter plate, said first and second cams and said feed member being mounted on said shaft.

4. Apparatus according to claim 1, wherein said adhesive strip support means comprises a rotatable turntable, and an oscillatable lever is provided and operably connected to said feed member, one of said cam means being engageable with said oscillatable lever for pivoting said feed arm into one of said first and second positions.

5. Apparatus according to claim 4, including adjustable means for limiting the pivotable movement of said feed member so as to thereby establish said first position, said one cam means having a contour so as to control the pivotal movement of said oscillating lever and thereby to establish said second pivotal position for said feed member, the extent of pivotal movement of said feed member thereby determining the length of adhesive strips to be provided.

6. Apparatus according to claim 4, wherein a second oscillatable lever is provided, a ratchet member is carried by said turntable to control the rotation thereof, another of said cams is engageable with said second oscillatable lever and said second oscillatable lever is pivotable by said another cam so as to activate said ratchet member and incrementally rotate said turntable.

7. Apparatus according to claim 6, wherein adjustable means are provided for limiting the pivotal movement of said second oscillatable lever and thereby regulating the extent of incremental rotation of said turntable.

8. Apparatus according to claim 7, wherein said adjustable means comprises an adjusting screw.

9. Apparatus according to claim 1, wherein said adhesive strip support means comprises a conveyor belt.

10. Apparatus according to claim 1, including an electric motor and a gear train drivable by said motor for driving said cam means.

* * * * *